United States Patent [19]

Crawford et al.

[11] 4,008,637

[45] Feb. 22, 1977

[54] APPARATUS FOR CUTTING HEMMED FABRIC PIECES

[75] Inventors: Douglas J. Crawford, Waterford; Roger LeMere, Petersburg; Francis H. Hughes, North Troy, all of N.Y.

[73] Assignee: Cluett, Peabody & Co., Inc., New York, N.Y.

[22] Filed: Apr. 23, 1975

[21] Appl. No.: 570,809

Related U.S. Application Data

[62] Division of Ser. No. 344,227, March 23, 1973, Pat. No. 3,898,941.

[52] U.S. Cl. ..... 83/155; 83/210; 83/277; 83/282

[51] Int. Cl.[2] ..... B26D 5/38

[58] Field of Search ..... 83/155, 210, 211, 276, 83/277, 282; 226/148, 158

[56] References Cited

UNITED STATES PATENTS

| | | | |
|---|---|---|---|
| 2,342,049 | 2/1944 | Holmbeck et al. | 83/277 X |
| 2,733,766 | 2/1966 | Wikle | 83/210 X |
| 3,172,323 | 3/1965 | Burd | 83/277 X |
| 3,458,381 | 7/1969 | Metcalfe | 83/277 X |
| 3,461,757 | 8/1969 | Healy et al. | 83/210 X |
| 3,701,299 | 10/1972 | Stumpf | 83/282 |
| 3,774,486 | 11/1973 | Johnsson | 83/277 X |

*Primary Examiner*—Frank T. Yost

[57] ABSTRACT

This disclosure teaches an apparatus for manufacturing and stacking hemmed fabric pieces (usually pockets) with the hems either lined or unlined. In the case of lined hemmed fabric pieces, pieces of a liner tape are fed in cut lengths in turn along a path. Limp fabric pieces (the pockets) are inserted manually by an operator and are positioned automatically each on one of the liner pieces. A hem is formed out of a margin of the fabric piece around its related liner piece and a terminal margin flap is tucked under itself. The hem is sewn along the terminal flap. The hemmed lined fabric pieces are then inserted in turn into a cartridge upwardly and the cartridge is revolved about a vertical axis as successive of the hemmed lined fabric pieces are inserted therein so that uneven height caused by the hems is distributed about the stack. In the case of unlined fabric pieces, the apparatus functions substantially the same in positioning the limp fabric pieces, hemming and stacking.

5 Claims, 6 Drawing Figures

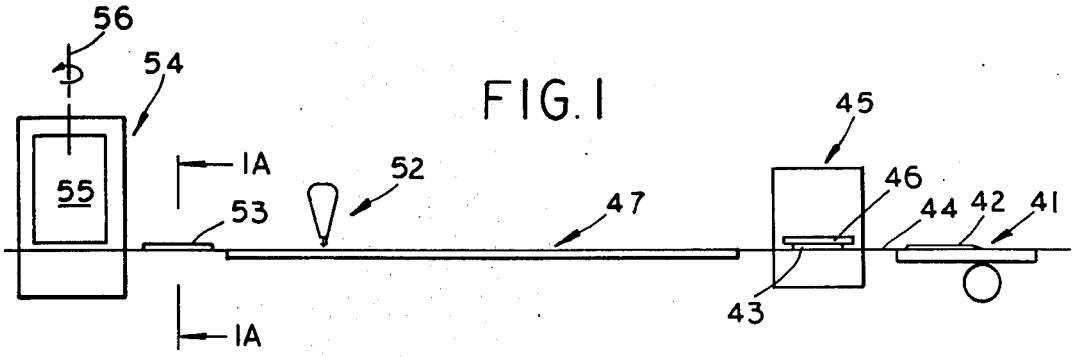
FIG. 1
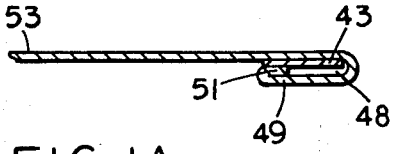
FIG. 1A
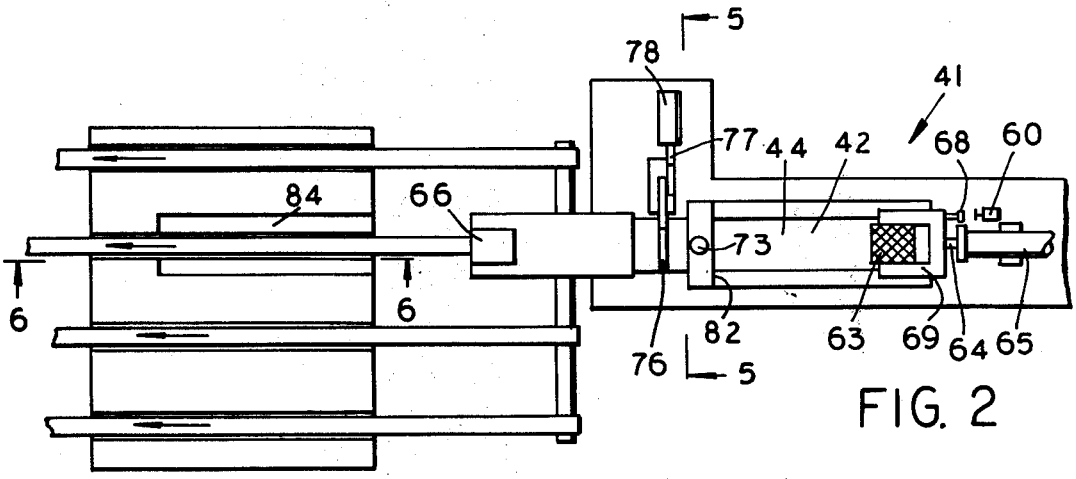
FIG. 2
FIG. 3
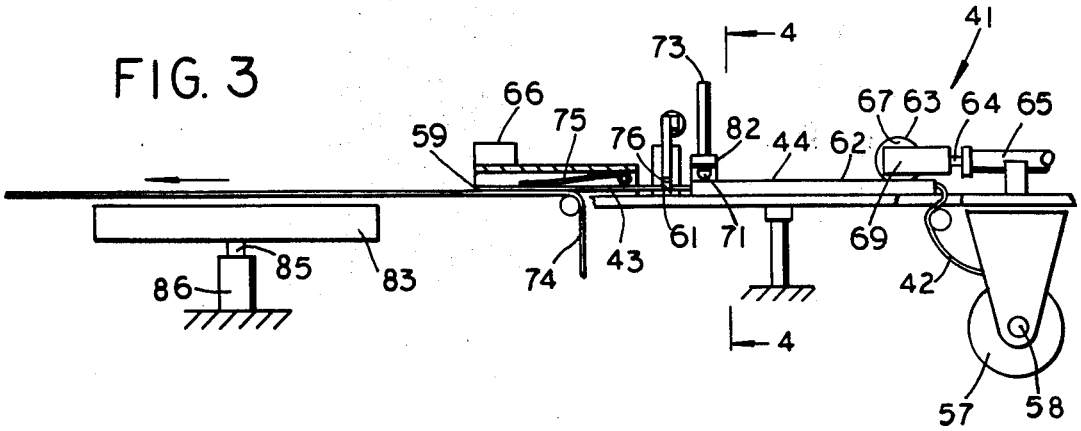

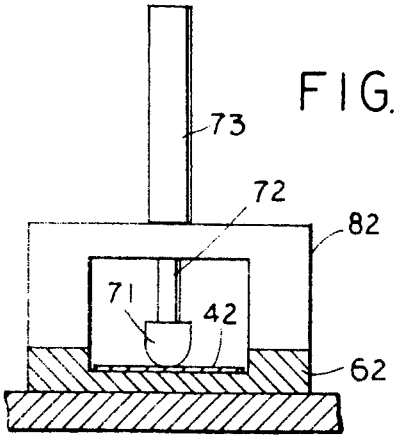
FIG. 4
FIG. 5
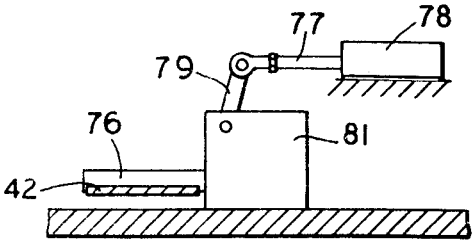

APPARATUS FOR CUTTING HEMMED FABRIC PIECES

This is a division of application Ser. No. 344,227, filed Mar. 23, 1973, now U.S. Pat. No. 3,898,941.

BACKGROUND OF INVENTION

According to the prior art, commercial sale manufacture and stacking of hemmed fabric pieces (such as pockets) was for the most part a manual operation performed by workers using substantially conventional sewing machines. Quality of the hemmed fabric pieces varied among individual workers and as an essentially hand operation there were inherent limitations in quality. The work was monotonous so there was danger of injury to workers. Labor costs in this operation were high and substantial waste of material was experienced. Further, stacking of the hemmed fabric pieces (lined or unlined) presented difficulty because the hemmed end being thicker than the other end caused stacks to build up on the hemmed end tending the stacks to fall over onto the unhemmed ends opposite to the hemmed ends.

With growing popularity of stretch fabrics, knitted fabrics and bias cut woven fabrics, hemming of pockets was usually impractical and at times impossible using apparati of the prior art.

The prior art with regard to dispensers, for cutting and feeding automatically pieces of a liner tape in turn along a path, has been directed to other services. However U.S. Pat. No. 3,479,911 taught an apparatus for clamping a web of flexible material, cutting the web into increments of length and advancing the web to a work station. U.S. Pat. No. 3,465,624 disclosed a control system for a film cutter. U.S. Pat. No. 3,400,622 showed an apparatus for cutting a strip material into pieces of incremental length and included moving, feeding and shearing functions. In U.S. Pat. No. 2,722,276 strip stock was fed from a roller by means of a self-releasing self-cocking trip-type clutch. U.S. Pat. Nos. 2,062,643 and 2,783,042 used one-way clutches on a friction roller for feeding paper from a stack to a machine. U.S. Pat. Nos. 1,127,991 and 1,536,670 related to feeding of paper to printing presses.

STATEMENT OF INVENTION

The present invention answers the problems of the prior art in a particularly useful, novel, unobvious and facile way. An apparatus has been developed for manufacturing and stacking hemmed fabric pieces such as pockets (lined or unlined). In the case of lined hemmed fabric pieces, pieces of liner tape are fed in lengths in turn along a path. The limp fabric pieces, inserted manually by an operator, are positioned automatically each on one of the liner pieces. A hem is formed from a margin of each of the fabric pieces around its related liner piece and a terminal margin flap is tucked under itself. The hem is sewn automatically along the terminal margin flap. For stacking, the lined hemmed fabric pieces are inserted into a cartridge upwardly and the cartridge is revolved about a vertical axis as successive of the lined hemmed fabric pieces are inserted therein so that uneven height caused by the lined hems is distributed peripherally about the stack.

Accordingly one object of this invention is to provide a simple, reliable and automatic apparatus for manufacturing lined hemmed fabric pieces.

Another object is to improve quality of the hemmed fabric pieces.

A still further object is to improve safety in manufacture of hemmed fabric pieces.

A still further object is to reduce costs in manufacture of the hemmed fabric pieces.

A still further object is to reduce waste of materials in manufacture of the hemmed fabric pieces.

A still further object is to provide apparatus for hemming stretch fabrics, knitted fabrics and bias cut woven fabrics.

BRIEF DESCRIPTION OF DRAWINGS

The foregoing and other features and advantages will be understood more fully from the following description of a detailed embodiment of the apparatus for manufacturing and stacking hemmed fabric pieces according to this invention viewed in conjunction with the accompanying drawings wherein:

FIG. 1 is a somewhat idealized elevation view showing general arrangement of the apparatus.

FIG. 1A is an elevation view in section showing a lined hemmed fabric piece.

FIG. 2 is a plan view of a liner tape dispenser.

FIG. 3 is an elevation view of the liner tape dispenser.

FIG. 4 is an elevation view in section taken along line 4—4 of FIG. 3 and showing a finger.

FIG. 5 is an elevation view in section taken along line 5—5 of FIG. 2 and showing a cutter.

DETAILED DESCRIPTION OF PREFERRED EMBODIMENT

This apparatus for manufacturing and stacking lined hemmed fabric pieces can be seen in FIG. 1 to comprise a dispenser (generally designated 41) for cutting and feeding automatically liner tape 42 of constant width in liner pieces 43 each of a same predetermined length in their lengthwise directions in turn along a path 44. A positioner (generally designated 45) is situated along the path 44 for accepting limp fabric pieces 46 inserted in turn manually and the positioner positioning each of the fabric pieces 46 automatically onto one of the liner pieces 43. From the positioner 45 the fabric pieces 46, each together with an associated liner piece 43, are delivered to a folder (generally designated 47) for forming a lined hem 48 out of a margin 49 of each of the fabric pieces 46 folded around its associated liner piece 43 and having a terminal margin flap 51 tucked under itself ready for sewing. A sewing machine (generally designated 52) is arranged for sewing the lined hem 48 along the terminal margin flap 51. Lined hemmed fabric pieces 53 are delivered thereafter to a stacker (generally designated 54) in which the lined hemmed fabric pieces 53 are loaded vertically upward into a cartridge 55 (see FIG. 30) which is arranged to revolve in increments about a vertical axis 56 so that, as successive of the lined hemmed fabric pieces 53 are inserted therein, uneven height caused by the lined hems 48 is distributed peripherally about the stack.

The dispenser 41 cuts and feeds automatically the liner tape 42 of constant width as the liner pieces 43 each of a like predetermined length lengthwise along the path 44. Tape supply spool 57 is mounted rotatably about a horizontal spool axis 58. A continuous feed of the liner tape 42 is wrapped on the spool 57 and the spool 57 is organized to rotate freely about the axis 58. The liner tape advances one of said predetermined lengths at a time forwardly along the path 44 to a cuttable position wherein the front end of a liner tape length is at 59 and its rear end is at 61. A feed platform 62 is organized along the path 44 to support the continuous liner tape 42.

Advancement is achieved by a pusher member which is shown as a roller 63 having a knurled surface for engaging the continuous liner tape 42. A first motion means is shown as a first piston 64 connected to the roller 63 and a first air cylinder 65 to provide two-way rectilinear movement of the roller 63 forwardly and rearwardly along the path 44. The first motion means is organized to move the roller 63 in response to a first signal from a first sensor 66 which indicates presence of the liner tape 42 in the cuttable position. The first motion means moves the roller 63 from an initial forward position against abutment 82 rearwardly to a rearward position shown in FIGS. 2 and 3. Slip means are provided in the form of a one-way clutch 67 in roller 63 whereby on moving rearwardly roller 63 rolls over the liner tape 42 but on moving forwardly roller 63 is prevented from rotating so that it engages the liner tape 42 to move it forwardly. When roller 63 reaches its rearward position shown in FIGS. 2 and 3 adjustment screw 68 connected thereto triggers switch 60 for automatic return of roller 63 to its forward position. Roller 63 is mounted on a shaft depending between yoke members 69 which engage the first piston 64 in the first air cylinder 65. The length of travel of the roller 63 can be varied by adjustment of the length of screw 68 to set the constant length of liner tape fed to the cuttable position on each movement of the roller 63 forwardly on the path 44.

A finger 71 retains the liner tape 42 on rearward movement of the roller 63. A second motion means, shown as a second piston 72 housed in a second air cylinder 73, is connected to the finger 71 for providing two-way movement vertically between an initial retracted position (not shown) wherein the finger 71 is above the feed platform 62 and a holding position shown in FIG. 4 wherein the finger 71 holds the liner tape 42 against the feed platform 62. A positioner endless belt 74 is arranged forward of the finger 71 along the path 44 and is organized to advance the liner tape 42 forwardly. A hold down element 75 is mounted to press the liner piece 43 onto the positioner endless belt 74. A cutter comprises knife 76 and is positioned along the path between the finger 71 and the hold down element 75. A third motion means, shown as a third piston 77 mounted in a third air cylinder 78, is connected to the knife 76 as shown in FIG. 5 via a lever 79 mounted for rotation on a fulcrum member 81, so that the knife 76 is movable between an initial retracted position wherein it is retracted and a cutting position shown in FIG. 5 wherein the knife cuts from the liner tape 42 one of the liner pieces 43.

The dispenser 41 operates from a starting arrangement with the first piston 64 extended to abutment 82, the second piston 72 in its retracted position and the third piston 77 in its retracted position. In this arrangement a length of the liner tape 42 is already in the cuttable position from 59 to 61. To start the operation the first signal is transmitted as has been mentioned from first sensor 66 via a dispenser circuit to the first air cylinder 65 advancing the first piston 64 to move the roller 63 rearwardly. Simultaneously a second signal is transmitted by the dispenser circuit to move the finger 71 to its holding position. The dispenser circuit is arranged then to transmit a third signal to the third air cylinder 78 to move the knife 76 to its cutting position. The dispenser circuit further includes second and third reset means to signal thereafter return of the finger 71 and the knife 76 respectively to their initial positions.

It will be understood by those familiar with manufacturing and stacking of lined hemmed fabric pieces that various deviations can be made from the foregoing preferred embodiment without departing from the theme of invention set forth in the claims.

We claim:

1. Apparatus for sequentially feeding individual elongated pieces of liner tape of equal length to a path defined by a continuously moving conveyor, characterized by a. supply means for supplying a continuous length of liner tape;

b. a cutting station for severing said continuous length of liner tape into said elongated pieces to be fed to said conveyor;

c. forward sensing means adjacent the upstream end of said conveyor for sensing the leading edge of said continuous length of liner tape and defining the forward end of said cutting station;

d. cutting means connected to said sensing means for cutting said continuous length of liner tape into said individual elongated pieces;

e. said cutting means defining the rearward end of said cutting station;

f. retractable liner tape advancing means for positively advancing sequentially the leading edge of said continuous length of liner tape in increments to said forward sensing means;

g. said advancing means including a wheel with a non-slip surface for engaging the leading edge of said continuous length of liner tape;

h. reversible power means connected to said advancing means for moving said advancing means;

i. a one-way slip clutch in said wheel preventing rotation thereof while advancing said continuous length of liner tape and allowing rotation while returning over said continuous length of liner tape; and j. retractable stop means connected to said sensing means for engaging and holding the leading end of said length of liner tape in said cutting station against the reverse movement of said advancing means;

k. said reversible power means retracting said wheel at the same time as the leading end of said liner tape is engaged by said retractable stop means followed by activation of said cutting means.

2. The apparatus of claim 1, further characterized by a. a channel-like feed platform defining the path of movement of said retractable advancing means for guiding said continuous length of tape to said cutting station.

3. The apparatus of claim 1, further characterized by a. said reversible power means comprising a fluid cylinder;

b. means for limiting the stroke of said fluid cylinder in one direction; and c. adjustable means for adjustably limiting the stroke of the cylinder in the other direction for defining the increments of said continuous liner tape fed to said cutting station.

4. The apparatus of claim 1, further characterized by a. a hold-down member in said cutting station for lightly pressing the leading end of said continuous length of material against said continuously moving conveyor.

5. The apparatus of claim 4, further characterized by a. said conveyor means provided adjacent the downstream side of said cutting means and under said hold-down member; and b. said conveyor means engaging the leading end of a severed elongated piece whereby said piece is conveyed away immediately upon severance thereof.

* * * * *